US007998276B1

(12) United States Patent
Baugh

(10) Patent No.: US 7,998,276 B1
(45) Date of Patent: Aug. 16, 2011

(54) PIPELINE REMEDIATION METHOD WITH WIRE ROPE PIG

(76) Inventor: Benton Frederick Baugh, Houston, TX (US)

( * ) Notice: Subject to any disclaimer, the term of this patent is extended or adjusted under 35 U.S.C. 154(b) by 547 days.

(21) Appl. No.: 12/151,215

(22) Filed: May 6, 2008

(51) Int. Cl.
*B08B 9/04* (2006.01)

(52) U.S. Cl. ..... 134/8; 134/22.11; 134/22.12

(58) Field of Classification Search ..... None
See application file for complete search history.

(56) References Cited

U.S. PATENT DOCUMENTS 3,768,500 A * 10/1973 Kauer et al. ..... 137/119.03
2004/0194809 A1* 10/2004 Crawford et al. ..... 134/22.12
* cited by examiner

*Primary Examiner* — Michael Kornakov
*Assistant Examiner* — Eric Golightly

(57) ABSTRACT

A method of remediating deposits within a pipeline by a pig within the pipeline which sealingly engages the internal diameter of the pipeline, holding back on the movement of the pig with a wire rope, pumping down the pipeline, providing a first passageway through the pig for pumping through flow restrictions on the pig to increase the velocity of the flow to enhance the effectiveness of the remediation, providing a second passageway through the pig with less flow restriction than the first passageway for flow through the pig during retrieval, and providing a selector valve for alternately directing flow through the pig to the first passageway and to the second passageway each time the flow is stopped and restarted.

5 Claims, 6 Drawing Sheets

PIPELINE REMEDIATION METHOD WITH WIRE ROPE PIG

CROSS-REFERENCE TO RELATED APPLICATIONS

N/A

STATEMENT REGARDING FEDERALLY SPONSORED RESEARCH OR DEVELOPMENT

N/A

INCORPORATION-BY-REFERENCE OF MATERIAL SUBMITTED ON A COMPACT DISK

N/A

BACKGROUND OF THE INVENTION

The field of this invention is that of tools used for the cleaning of pipelines, especially the long extended reach pipelines in offshore areas. As hot production crude is produced from the reservoirs below the ocean floor up to the wellhead equipment at the ocean floor and then through pipelines along the ocean floor, it is cooled by the relatively cool temperature of the ocean water. In deepwater, the temperature can be as cold as 35 degrees Fahrenheit.

A characteristic common to a majority of the oil produced is that there is a paraffin component to the oil which will deposit on the walls of the pipeline and become a solid at temperatures well above the 35 degrees Fahrenheit. In fact, some of the paraffins become solid at temperatures above 100 degrees Fahrenheit, and so can be deposited or plated on the internal diameters of the pipelines at any expected ambient temperature. The process is similar to discussions of blocking of the arteries of a human being, with a thicker coating building up with time. Some pipelines have become so plugged that more than 90% of the flow area is blocked with the waxes or paraffins.

Typically, the wall becomes layered with paraffin as the temperature of the oil goes below the solidification temperature of the particular paraffins in the produced fluids. The paraffins act as a sort of insulation to the flowing fluids in the pipeline, allowing it to maintain a higher temperature for a greater distance. The effect of this is to extend the distance along the pipeline which the paraffin is plating onto the internal diameter of the pipeline.

A common cure for the paraffin plating out on the internal diameter of the pipeline is to insert a pig into the flow stream and let the pig remove some of the paraffin. A pig is typically a cylindrical or spherical tool which will brush against the internal diameter of the pipeline in hopes of removing the deposited paraffins. In pipelines with a high incidence of deposited paraffins, a regular maintenance of pigs is normally prescribed as a preventative to pipeline blockage.

One problem with the pigs is that the deposited paraffins are relatively soft and contain a lot of oil. To some extent, the pigs actually compress the paraffins against the wall and squeeze the oil out, leaving a harder and stronger paraffin remaining.

A second problem is that when the paraffin layer on the internal diameter of the pipe is too thick, sloughing off may occur. If the paraffin starts to separate from the wall and continues, the pig begins to literally plow a block of paraffin ahead of itself. This will continue driving more and more paraffin off the wall of the pipeline until the pressure of the pipeline will no longer be able to move the mass. At that time you have full pipeline blockage, which cannot be moved by pressure from either end.

At that time the plug of paraffin must be removed by chemicals. Characteristically, the way chemicals are deployed to the location of the blockage is to use a string of coiled pipe or coiled tubing which is unreeled into the pipeline to provide a circulation path for the circulation of chemicals. As the end of the coiled tubing pipe reaches the location of the blockage, the chemicals are circulated either out the coiled tubing and back through the annulus outside of the coiled tubing and inside the pipeline, or the flow will be in the opposite direction.

BRIEF SUMMARY OF THE INVENTION

The object of this invention is to provide a method for removing paraffin buildups on the inside of the pipeline, without allowing the free movement of a pig which tends to cause breaking the paraffin off the wall, thus causing blockages.

A second object of the present invention is to provide a method for causing a jetting action in a pipeline at the desired location for remediating wax buildup.

A third object of the present invention is to a method of providing a mechanical enhancement of chemical action at remote locations within a pipeline.

Another object of the present invention is to provide a means for venting the fluid across the pig when pulling the pig back to the point of entry in the pipeline.

DETAILED DESCRIPTION OF THE INVENTION

Figure 1:
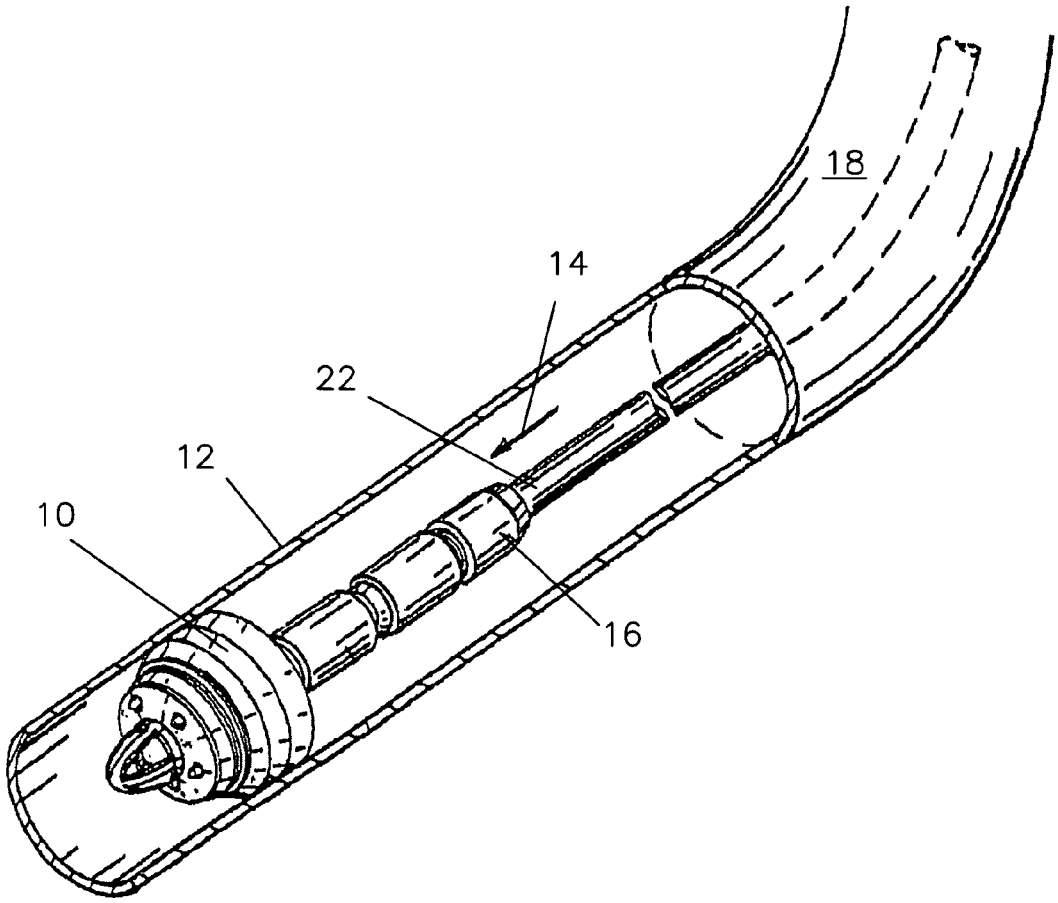
FIG. 1 is a partial perspective section of the present invention showing the basic components of the wire rope pig.

FIG. 1 shows a wire rope pig 10 inside a pipeline 12. Flow normally approaches the pig along the annular area in the direction as indicated by arrow 14 to both move the pig forward and provide fluid to vent across the pig for cleaning the pipeline ahead of the pig. When the wire rope pig is pulled back to the end of the pipeline into which it was inserted, the fluid in the pipeline will be stationary and the pig pulled backwards with the pipeline fluid venting through the pig, giving the same relative motion of the fluids relative to the pig. If the fluids could not be vented back through the pig, all of the fluids in the pipeline behind the pig would have to be "swabbed" or flushed back to the point of inserting of the pig into the pipeline, except what might go through the jet nozzles.

A wire rope socket 16 and one or more ball joints 20 are provided as a part of the wire rope pig. The wire rope socket 16 attaches wire rope 22 to the wire rope pig to restrain the movement of the wire rope pig 10 against the flow in the direction of arrow 14. The ball joints 20 are useful in assisting the wire rope pigs 10 in traveling around pipe bends such as indicated at 18.

Figure 2:
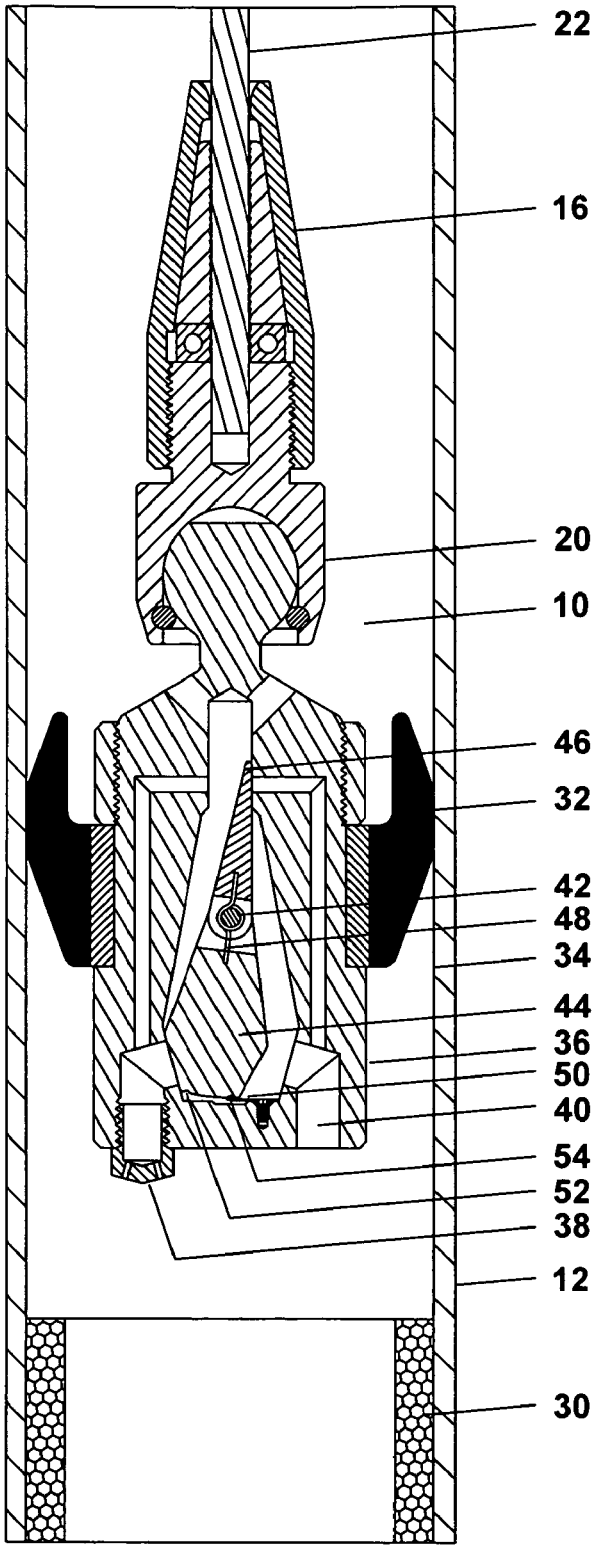
FIG. 2 is a half section of the present invention showing a first configuration prior to flow.

Referring now to FIG. 2, pipeline 12 is shown with a wax or paraffin buildup 30 within the bore which is to be cleaned by the pig. Wire rope pig 10 provides a flexible sealing cup 32 which sealingly engages the internal bore of the pipeline 34. The sealing cups are made of a relatively soft material, such as 70 durometer Buna N Hycar®, which would be considered a durable rubber type product. A wire rope socket 16 is attached to the end of the pig 10 to connect to wire rope 22. A variety of method such as slips, lead filled sockets and wedges can be used for this type connection. These are well known in the wire rope business.

Main body 36 of the wire rope pig 10 provides a jetting port 38, a venting port 40, and an axle 42. Gate 44 and diverter 46 are pivotably mounted on axle 42. Spring 48 is mounted around axle 42 and engages gate 44 and diverter 46. Spring 48 tends to keep gate 44 and diverter 46 aligned, but will allow them to swing independently to different angles. A leaf spring 50 which is mounted on main body 36 engages grooves 52 and 54 to detent the gate in one of two position during the operation of the pig. The pig in FIG. 2 is shown in the initial position as inserted into the pipeline without any flow being applied.

Figure 3:
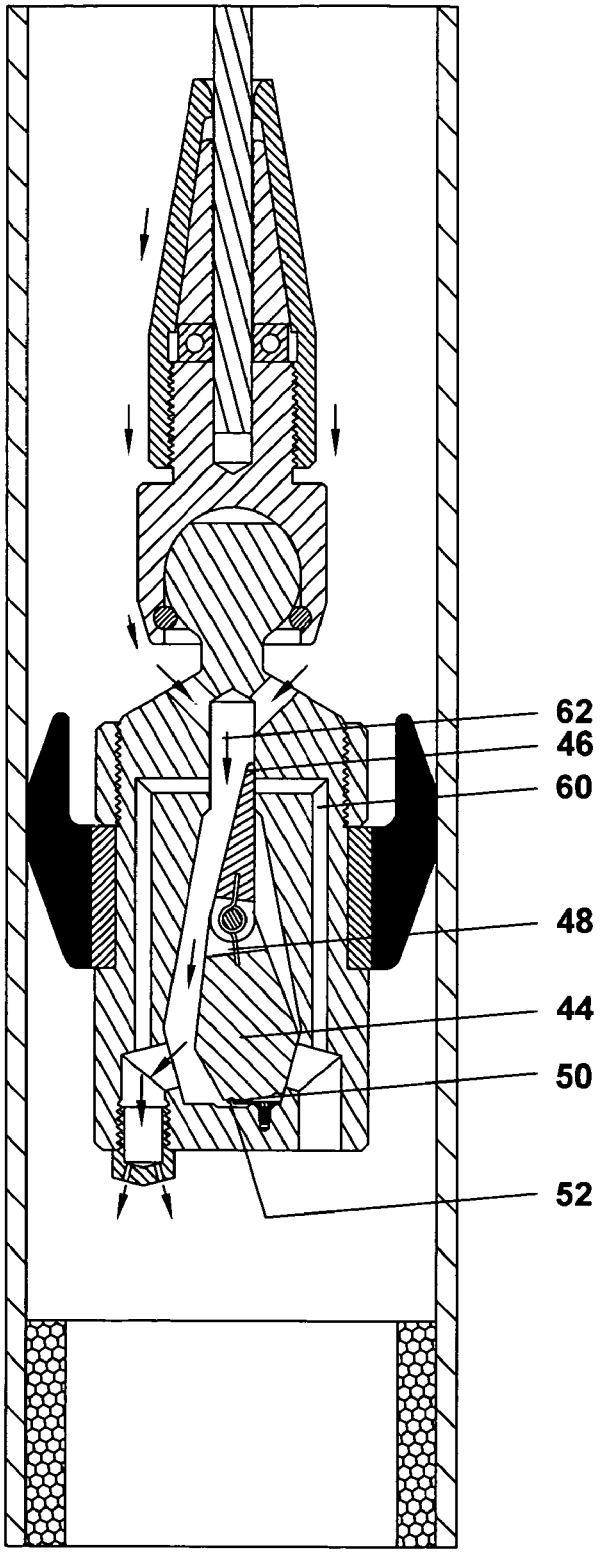
FIG. 3 is a half section of the present invention showing the diverter and gate positions after initial flow which is directing the fluids to the jetting nozzles.

Referring now to FIG. 3, the figure illustrates what happens when flow through the pig is applied, either by pumping toward the pig or by pulling the pig back against the non-flowing fluid behind the pig. The gate 44 is pushed in a counterclockwise direction to allow the flow coming past the diverter 46 to exit through the jetting nozzles. The gate 44 is not detented in the groove 52 by leaf spring 50. This is the position for the pig 10 to be moved forward and to jet clean the pipeline as it does. The spring 48 urges the diverter to be moved to a new counterclockwise position also, however the higher pressure in chamber 62 than in port 60 provides a force to overcome the spring force and keep the diverter from moving.

Figure 4:
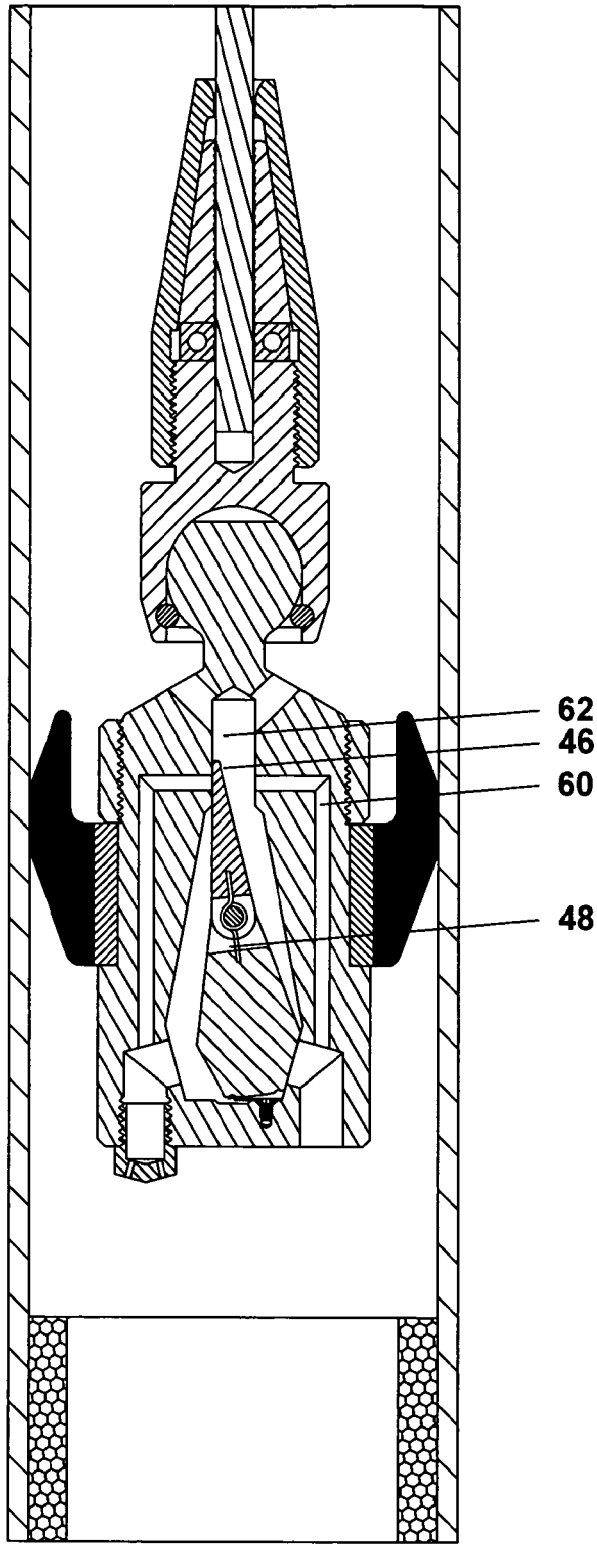
FIG. 4 is a half section of the present invention showing the diverter switched to the alternate position after flow stops.

Referring now to FIG. 4, flow is stopped and the pressure in port 60 equalized with the pressure in chamber 62 and the spring 48 is able to move the diverter 46 to the new position.

Figure 5:
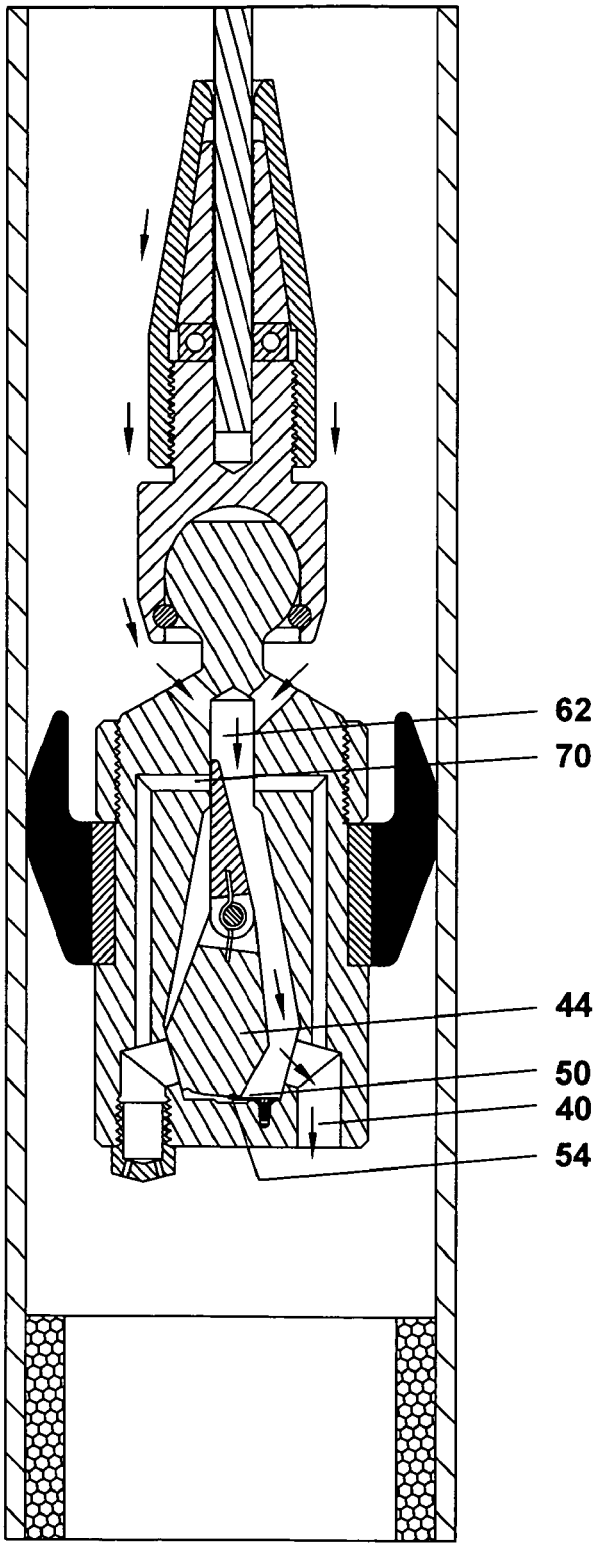
FIG. 5 is a half section of the present invention showing the diverter and gate positions after resumed flow which is directing the fluids to the vent port.

Referring now to FIG. 5, flow is resumed and the gate 44 is moved to the clockwise position and leaf spring 50 is detented into groove 54. Flow is directed to the large vent port 40 for relatively free flow through the pig. This will be the position of the gate 44 when the pig is being returned to the starting point, allow the fluid behind the pig to move freely through the pig rather than being forced through jet nozzles. The spring 48 urges the diverter to be moved to a new clockwise position also, however the higher pressure in chamber 62 than in port 70 provides a force to overcome the spring force and keep the diverter from moving.

Figure 6:
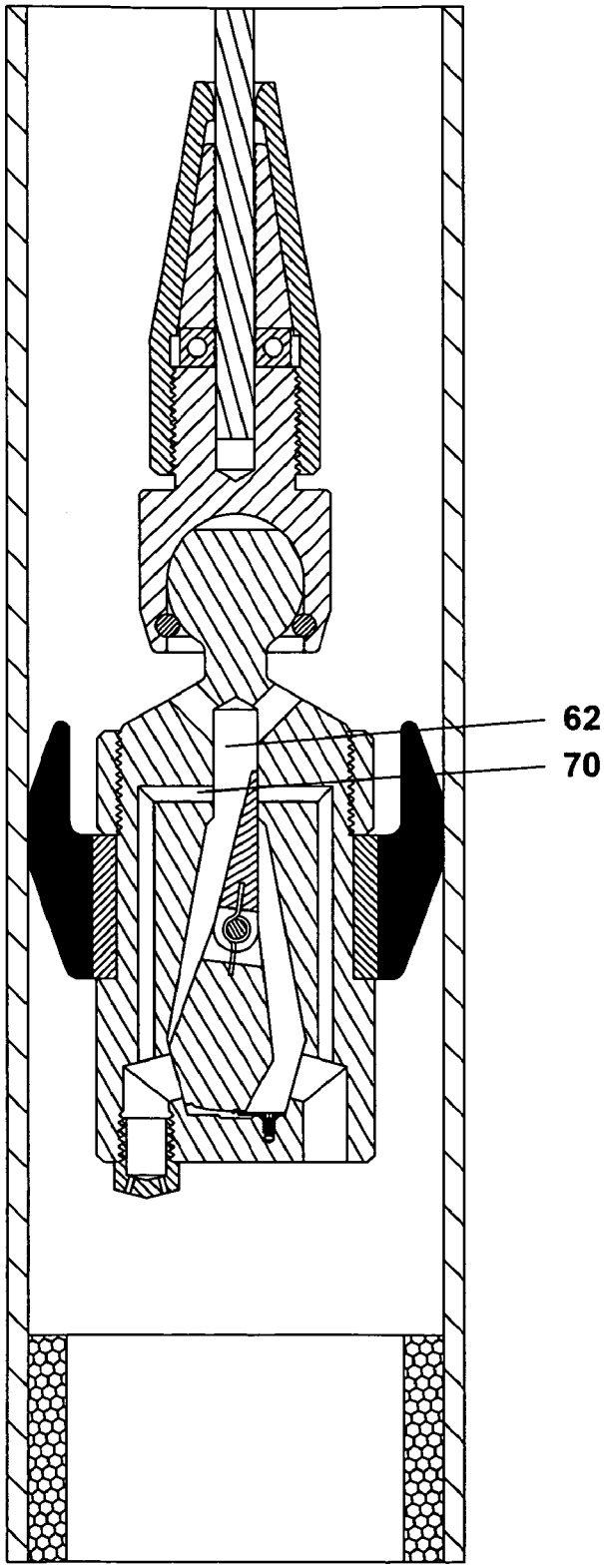
FIG. 6 is a half section of the present invention showing the diverter switched back to the original position after the flow stops.

Referring now to FIG. 6, flow is stopped again and the pressure in port 70 equalized with the pressure in chamber 62 and the spring 48 is able to move the diverter 46 to the new position. This is the same position as was seen in FIG. 2.

The figures have described a single cycle of how the flow is alternately directed to the jetting ports 38 for jetting and moving forward; and to the vent port 40 for returning the pig to the starting point. This cycle can be repeated as often as desired. If jetting is stopped and needs to be restarted, the operator will start the pumps once to go through the vent cycle, stop the pumps, and start the pumps a second time to get back to jetting.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

The invention claimed is:

1. A method of remediating deposits within a pipeline comprising:

providing a pig within said pipeline which sealingly engages the internal diameter of said pipeline, restraining movement of said pig, pumping down the pipeline to flow at a first velocity without taking return flow back up the pipeline, providing a first passageway through said pig for pumping through flow restrictions on said pig to increase said velocity of said flow to enhance the cleaning effectiveness of the remediation relative to the cleaning effectiveness of said flow at said first velocity, providing a second passageway through said pig with less flow restriction than said first passageway for flow through said pig, and providing a selector valve for alternately directing flow through said pig to said first passageway and to said second passageway each time said flow is stopped and restarted wherein said selector valve provides a flow diverter to alternately direct said flow to said first passageway and said second passageway wherein when said flow is directed to said first passageway, said flow moves a gate to block said flow from said second passageway and, wherein when said gate moves to block said flow from said second passageway, said gate provides a force to urge said diverter to a position to direct said flow to said second passageway.

2. The method of claim 1, further comprising providing a spring to provide said force to urge said diverter to said position to direct said flow to said second passageway.

3. The method of claim 1, further comprising providing a restraining force to prevent said diverter from moving to said position to direct said flow to said second passageway.

4. The method of claim 3, further comprising that when said flow is stopped, said diverter automatically moves to said position to direct said flow to said second passageway.

5. The method of claim 3, wherein said restraining force is a pressure differential.

* * * * *